United States Patent [19]

Lambias

[11] 4,078,334

[45] Mar. 14, 1978

[54] AIR SEAL

[75] Inventor: Joseph N. Lambias, Sommerville, Mass.

[73] Assignee: Eckel Industries, Inc., Cambridge, Mass.

[21] Appl. No.: 777,171

[22] Filed: Mar. 14, 1977

[51] Int. Cl.[2] ..... E05F 1/06

[52] U.S. Cl. ..... 49/237; 49/383; 49/475

[58] Field of Search ..... 49/4, 34, 236–239, 49/498, 383; 160/354

[56] References Cited

U.S. PATENT DOCUMENTS

| | | | |
|---|---|---|---|
| 2,760,567 | 8/1956 | Eckel et al. | 160/354 X |
| 3,384,996 | 5/1968 | Gilchrist et al. | 49/383 |
| 3,464,162 | 9/1969 | Ingham | 49/383 |

*Primary Examiner*—Kenneth Downey
*Attorney, Agent, or Firm*—Schiller & Pandiscio

[57] ABSTRACT

An air seal is provided for restraining the flow of air through a cut-out section of a door which accommodates a door closing mechanism. A pair of nested cover strips individually flexed to a U-shaped configuration is mounted astride the mechanism, the bight of the outer strip resiliently abutting a vertical surface of the cut-out section in air sealing contact. The inner strip, which has greater resistance to flexing than the outer strip, contacts the side sections of the outer strip to stiffen them against flexing as the door is swung about its support. Both strips terminate in a fringed margin to accommodate the vertical rise of the lower boundary surface of the cut-out section as the door swings away from its closed position.

9 Claims, 3 Drawing Figures

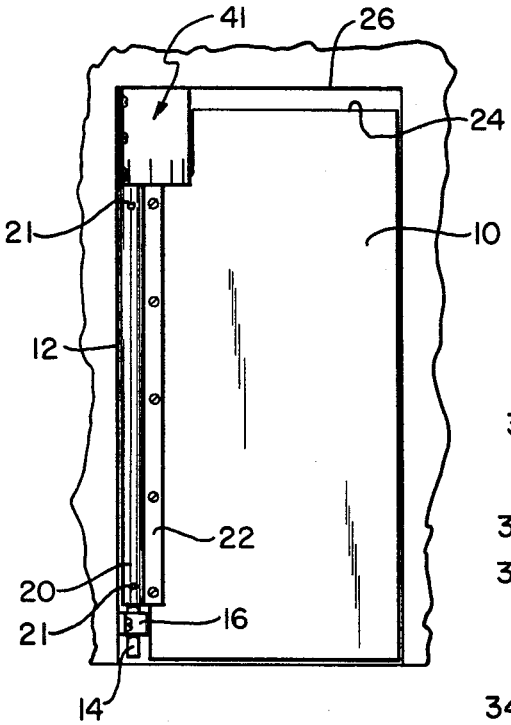
FIG. 1
FIG. 2
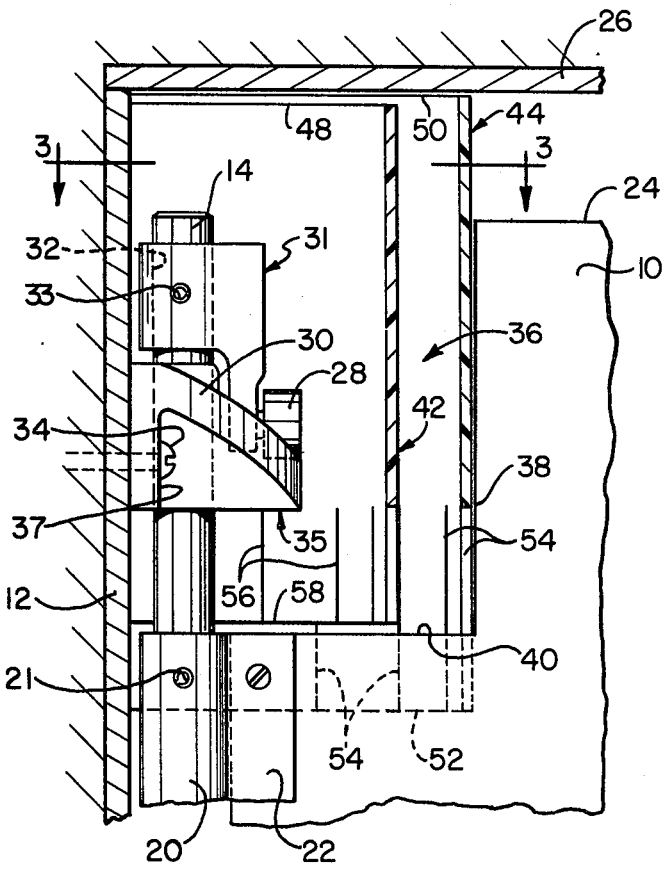
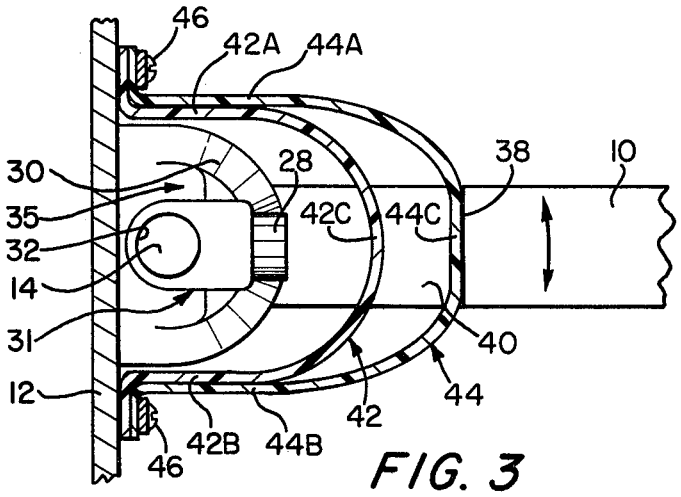
FIG. 3

AIR SEAL

The present invention relates in general to new and improved air seals for doors and in particular to air seals for self-closing doors.

BACKGROUND OF THE INVENTION

Doors of the kind that swing in either direction from a closed position are well known in the art. Various closing devices may be used with such doors, for example a cam bearing of the type disclosed in U.S. Pat. No. 3,384,996. In the aforesaid cam bearing of the cam follower, usually in the form of a roller, follows a curved cam track that is elevated on both sides of a central low point which coincides with the closed position of the door. The track is normally mounted on the door jamb, i.e. the vertical member of the door frame about which the door is arranged to swing. When the door is swung to either side of the closed position, the roller rides up on the track. Since the roller is connected to the door through an intermediate structure, it lifts the door vertically by a corresponding amount relative to the jamb. When the door is released, the roller returns to the low point on the track and returns the door to its closed position. In the process the door is lowered to its previous level.

The cam bearing mechanism is normally mounted on the door jamb near the lintel piece, i.e., near the horizontal member of the door frame. A cut-out section of the door, which may have a substantially rectangular configuration, provides the necessary clearance to accommodate the mechanism as the door swings between its open and closed positions. If the door is to act as an effective barrier between the two spaces separated by it, e.g., to seal out kitchen odors from a dining area, the transfer of air between the two spaces must be effectively restrained when the door is in its closed position. Since the door closing mechanism blocks air transfer through the aforesaid cut-out section only partially, a seal is required that will effectively block the passage of air through this space when the door is closed.

In prior art devices of the type disclosed in the aforesaid U.S. Pat. No. 3,384,996, a flexible sealing flap is used for the purpose. Typically, the flap is of a size sufficient to cover the rectangular cut-out section and is mounted on the door jamb so as to resiliently bear against the swinging door. A minimum degree of stiffness is required in order to provide an effective seal. Such stiffness, however, increases the resistance which must be overcome in order to swing the door out of its closed position. Reducing the stiffness of the flap also reduces its effectiveness as a seal. The sealing function is further impaired when, due to repeated motion of the swinging door, the flap loses its flexibility and acquires a set that permits the air to pass through the cut-out.

The problem is further compounded by the fact that the door closing mechanism, particularly for heavy doors, is frequently of a size where it extends beyond the thickness dimension of the door. Where that is the case, the use of a substantially planar, flexible flap no longer presents a feasible solution, due largely to interference by the protruding mechanism and to the relative dimensions of the other components of the door structure.

OBJECTS OF THE INVENTION

Accordingly it is the primary object of the present invention to provide an improved air seal for covering an opening in a door which is not subject to the disadvantages of prior art devices.

It is another object of the present invention to provide an effective air seal for a cut-out section of a door, which is capable of accommodating a door closing mechanism that extends beyond the thickness dimension of the door.

It is a further object of the present invention to provide a jamb-mounted air seal for a self-closing door which imposes no significant resistance to the movement of the door.

It is still another object of the present invention to provide an air seal for a self-closing door which retains its flexible properties during repeated operation of the door so as to provide proper sealing throughout a prolonged period of use.

These and other objects of the present invention together with the features and advantages thereof will become apparent from the following detailed specification when considered in conjunction with the accompanying drawing.

BRIEF DESCRIPTION OF THE DRAWING

FIG. 1 is an elevation view of a door embodying the present invention;

FIG. 2 is a cross-sectional elevation view illustrating certain details of the present invention; and FIG. 3 is a cross-sectional view taken at line 3—3 of FIG. 2.

DESCRIPTION OF THE INVENTION

With reference now to the drawing, a door 10, set into a door frame, is adapted to swing about a door jamb 12 which constitutes a vertical member of the frame. A post 14 is rotatably supported in a lower bearing 16 and in an upper bearing which is generally designated by the reference numeral 35. Both bearings are secured to door jamb 12. A split sleeve 20 surrounds post 14 and is fastened thereto by pins 21. Where it is split, sleeve 20 terminates in a pair of parallel marginal support strips 22 which are attached to the body of door 10. For the sake of clarity, only one of the support strips is shown in the drawing. In the illustrated closed position of the door, the top edge 24 of door 10 is spaced from lintel 26 of the door frame.

Upper bearing 35 is generally the same as the bearing 26 shown in U.S. Pat. No. 3,384,996. As such it is designed to form part of a cam mechanism and accordingly is shaped to provide a cam track 30 on which rides a cam follower in the form of a roller 28. Roller 28 is carried by a support structure 31 which has a hollow section 32 that snugly surrounds post 14 and is affixed thereto by a pin 33. Bearing 35 has opposite side sections 37 (only one of which is shown) that are secured to door jamb 12 by means of screws 34. As illustrated in FIG. 3, the cam bearing mechanism exceeds the thickness dimension of door 10.

As door 10 is swung in either direction, roller 28 rides up on the track 30 and thereby axially raises post 14 to which it is coupled. The aforesaid axial movement is permitted by upper bearing 35 and lower bearing 16. Accordingly, a sleeve 20 which is pinned to post 14, and door 10 which is fastened to the sleeve, are lifted by the same amount. The spacing between top edge 24 of door 10 and lintel 26 allows for the vertical motion of the door as the latter is swung out of its closed position.

A cut-out section 36 in door 10 provides clearance for the upper bearing 35 and the associated cam follower so that the latter will not interfere with swinging movement of door 10. Cutout 36 defines a substantially rectangular area bounded by jamb 12, lintel 26, a surface 38 which is parallel to jamb 12 and a lower boundary surface 40 which is parallel to lintel 26. The air seal which blocks the passage of air through cut-out section 36 is generally indicated by reference numeral 41 in FIG. 1 to illustrate its position with reference to the door. It will be clear, however, that bearing 35 may be mounted anywhere along jamb 12 with a corresponding displacement in position of cut-out 36 and seal 41.

The details of the air seal which forms the subject matter of the present invention are best seen from FIGS. 2 and 3. A resilient cover strip 42 is flexed into a substantially U-shaped configuration and is so mounted on jamb 12 astride cam bearing mechanism 18. A further resilient cover strip 44 is similarly flexed into a substantially U-shaped configuration and is surmounted on cover strip 42 so that the latter is nested within cover strip 44. While both strips consist of a resilient material, in a preferred embodiment of the invention strip 42 offers greater resistance to flexing. As shown in FIG. 3, both strips are jointly mounted on the jamb by means of screws 46. By way of example, strip 42 and 44 may be made of a natural or synthetic rubber, a resilient fabric such as a canvas coated with a rubber, or a resilient plastic such as polyethylene.

The side sections of strip 42 are designated 42A and 42B respectively and are seen to be substantially parallel to door 10 when the door is in its closed position. Similarly, side sections 44A and 44B of strip 44 are substantially parallel to the plane of door 10 and are positioned in contact with side sections 44A and 44B. The bight of U-shaped strip 42 is designated 42C and is seen to extend through cut-out section 36. Likewise, bight 44C of U-shaped strip 44 extends through cut-out section 36. However, the lengths of strips 42 and 44 are chosen such that bight 44C resiliently abuts surface 38 of the cut-out section in a manner which distorts the natural configuration of the bight, while bight 42C is spaced from bight 44C by a suitable amount, e.g. about 0.75 inch. Strip 42 is defined by a top edge 48 and a bottom edge 58. Strip 44 is defined by a top edge 50 and a bottom edge 52.

For the purpose of illustration, top edges 48 and 50 of strips 42 and 44 respectively are separately shown in FIG. 2. However in a preferred embodiment of the invention both strips will rise substantially to the same height so as to abut lintel 26 edgewise in air-sealing relationship. Similarly, lower edges 58 and 52 of strips 42 and 44 respectively are shown at different heights, i.e. above and below the level of lower boundary surface 40. While the latter is a possible arrangement which is illustrated for the sake of clarity, in a preferred embodiment of the invention both strips extend to the level of lower edge 52.

Strip 44 further includes a fringed margin consisting of a succession of cuts 54, each starting at lower edge 52 and continuing upward beyond lower boundary surface 40. In a preferred embodiment of the invention, cuts 54 are parallel to jamb 12 and are uniformly spaced from each other so as to define adjacent fringe segments of uniform width. Similarly, strip 42 includes a series of cuts 56 extending upward from lower edge 58 and parallel to jamb 12. Here again the cuts are preferably uniformly spaced so as to define adjacent fringe segments of uniform width. As illustrated in FIG. 2, the cuts are placed at staggered intervals in the respective strips so that the fringe segments of the separate strips are laterally displaced with respect to each other. Accordingly, each fringe segment overlaps a cut in the other strip so as to enhance the air-blocking properties of the seal.

In operation, when door 10 is swung about post 14, strip 44 remains resiliently in contact with surface 38 which travels along the outside of this strip. As is the case in the open door position, the bight of strip 44 is distorted in all positions of the door where contact between the bight and surface 38 is maintained. The gap between bights 42C and 44C permits bight 44C to flex as required to maintain contact with door surface 38 as the door is swung so that, due to the compliance of the material chosen for strip 44, substantially no resistance is imposed to the movement of the door.

It will be clear that the movement of door 10 will also tend to pull side sections 44A and 44B out of the position shown in FIG. 3 so as to effectively collapse the U-shaped configuration of strip 44. However, strip 42 consists of a relatively stiff material which resists flexing to a greater extent than does strip 44. Thus, the presence of strip 42 serves to shore up side sections 44A and 44B which are in contact with sections 42A and 42B respectively. As a consequence, while the bight of strip 44 will flex with the movement of door 10 so as to remain in sealing contact with surface 38, side sections 44A and 44B, strengthened by side sections 42A and 42B respectively, resist flexing and prevent the collapse of the U-shaped configuration of strip 44.

As door 10 pivots about post 14 while being simultaneously lifted, lower boundary surface 40 will move likewise and will simultaneously displace whatever fringe segments are located in its path. However, on both sides of the door the fringe segments will extend below surface 40 so as to minimize the transfer of air through cut-out 36. It will be clear that the fringe segments do not materially interfere with the movement of surface 40, whether due to the pivoting motion of the door or due to its vertical displacement, as the door swings out of its closed position. Thus, an effective air seal is maintained without significantly increasing the resistance to the motion of the door.

It will be clear from the foregoing discussion that the present invention provides an effective sealing function with respect to the cut-out section of door 10. It will also be apparent that other spaces between the door and the door frame need to be sealed, e.g. the space between door edge 24 and lintel 26, in order to effectively block the passage of air. However, separate sealing means are required for these other spaces, which are beyond the scope of the present invention and form no part thereof.

The present invention is not limited to the specific embodiment described and illustrated. Various modifications and substitutions may be made within the broad scope of the invention. Thus, it will be clear that the door closing mechanism need not be located in the precise position shown, i.e. at the upper left hand corner of the door and that a suitable cut-out section may be provided whereever such mechanism is positioned. Further, the air seal to which the present invention is directed is not limited to a cut-out section such as illustrated herein, nor is it solely operable with a space which provides clearance for cam bearing mechanism.

The invention is applicable to cut-outs that accommodate different types of door-related hardware; to cut-out areas having different configurations; and to different types of closures.

The two strips 42 and 44 preferably have different degrees of stiffness. However, since the presence of the contacting side sections of the inner strip alone enhances the stiffness of the outer strip side sections, is also possible for the two strips to have the same degree of resilience.

From the foregoing explanation, it will be apparent that numerous modifications, substitutions and equivalents will now occur to those skilled in the art, all of which fall within the spirit and scope of the present invention, as defined by the appended claims.

What is claimed is:

1. An air seal for restraining the flow of air through a cut-out section of a door, said cut-out section being adapted to provide clearance for a structure mounted on the jamb of said door and including a surface spaced from said structure and substantially parallel to said jamb when said door is in its closed position; said seal comprising:

a cover strip flexed into a substantially U-shaped configuration and mounted astride said structure on said jamb, said U-shaped strip including a pair of opposite side sections and a bight section which extends through said cut-out section and resiliently abuts said surface substantially along the full length of the latter in a direction parallel to said jamb, the length of said strip being chosen to cause the natural configuration of said abutting bight to be distorted by said surface; and means for stiffening at least a portion of said opposite side sections;

whereby said surface progressively contacts different portions of said strip and said side sections remain substantially parallel to each other as said door swings about said jamb.

2. The apparatus of claim 1 wherein the mutual spacing of said side sections exceeds the thickness of said door; and wherein said stiffening means is disposed within said U-shaped configuration.

3. The apparatus of claim 2 wherein said stiffening means comprises a second cover strip flexed into a substantially U-shaped configuration and mounted astride said structure on said jamb, said second strip including a pair of side sections that are generally parallel to the side sections of said first-recited strip and in contact with the latter, the bight of said second U-shaped strip extending through said cut-out section and being positioned intermediate said structure and the bight of said first-recited strip.

4. The apparatus of claim 3 wherein said first-recited strip is surmounted on said second strip on said jamb.

5. The apparatus of claim 3 wherein the stiffness of said second strip exceeds that of said first-recited strip.

6. The apparatus of claim 5 wherein said jamb-mounted structure comprises a door closing mechanism adapted to lift said door as it rotates out of said closed position and wherein said cut-out section includes a lower boundary surface adapted to rise with said door;

said seal further comprising a fringed margin terminating each of said strips in the vicinity of said lower boundary surface, said margins being adapted to engage said last-recited surface in air-sealing relationship.

7. The apparatus of claim 6 wherein the lower edge of at least one of said strips is positioned below said lower boundary surface;

each of said fringed margins comprising a succession of cuts substantially parallel to said jamb and extending a limited distance upward from said lower strip edge, said cuts defining a plurality of fringe segments of predetermined width laterally displaced from the fringe segments of the other strip to overlap the cuts of the latter.

8. In combination with a door wherein a mechanism mounted on the door-supporting jamb returns said door to its closed position, an air seal adapted to restrain the flow of air through a cut-out section of said door, said cut-out section defining a rectangular space with said jamb and the lintel above said door and being adapted to provide clearance for said mechanism as said door rotates;

said seal comprising:

resilient inner and outer cover strips each flexed into a U-shaped configuration, the resistance to flexing of said inner strip exceeding that of said outer strip;

means for mounting said strips in mutually nested relationship on said jamb astride said mechanism;

each of said U-shaped configurations including a pair of mutually spaced side sections substantially parallel to said door in said closed door position;

the side sections of said inner strip contacting at least a portion of the side sections of said outer strip;

the bight of said outer strip extending through said cut-out section and resiliently abutting a surface of the latter parallel to said jamb, the length of said outer strip being chosen to cause the natural configuration of said abutting bight to be distorted by said surface; and the bight of said inner strip extending through said cut-out section and being positioned intermediate said mechanism and the bight of said outer strip;

whereby said surface progressively contacts different portions of said outer strip and said side sections remain substantially parallel to each other as said door swings about said jamb.

9. The apparatus of claim 8 wherein said door closing mechansim is adapted to lift said door vertically as it swings out of said closed position;

the lower edge of at least said outer strip extending below the lower boundary surface of said cut-out section in said closed door position;

each of said strips including a succession of spaced cuts substantially parallel to said jamb and extending a limited distance upward from the lower strip edge, said cuts defining a plurality of fringe segments of predetermined width in each of said strips laterally displaced from the fringe segments of the other strip to overlap the cuts of the latter;

whereby said fringe segments are adapted to straddle said lower boundary surface to contact opposite surfaces of said door in air-sealing relationship as said door is swung out of its closed position.

* * * * *